US005561929A

United States Patent [19]

Bell et al.

[11] Patent Number: 5,561,929

[45] Date of Patent: Oct. 8, 1996

[54] ROTARY CARD FILES

[75] Inventors: Randall Bell, 7922 Augusta Dr., River Forest, Ill. 60305; Kim Vollendorf, McHenry, Ill.

[73] Assignee: Randall Bell, River Forest, Ill.

[21] Appl. No.: 250,481

[22] Filed: May 27, 1994

[51] Int. Cl.[6] ..... B42F 13/12

[52] U.S. Cl. ..... 40/379; 40/377; 70/159

[58] Field of Search ..... 40/377, 378, 379, 40/493; 312/9.45, 9.46, 186; 206/308.1, 308.3; 70/158, 159, 316

[56] References Cited

U.S. PATENT DOCUMENTS

| | | | |
|---|---|---|---|
| 1,144,173 | 6/1915 | Corcoran | 40/377 |
| 2,703,744 | 3/1955 | Karper | 40/379 X |
| 2,731,017 | 1/1956 | Neilsen | 40/378 |
| 3,253,872 | 5/1966 | Gustafson | 40/379 X |
| 4,079,531 | 3/1978 | Norris et al. | 40/379 |
| 4,231,624 | 11/1980 | Neilsen | 40/377 X |
| 4,686,842 | 8/1987 | Chen | 70/316 X |
| 4,711,108 | 12/1987 | Garro | 70/316 X |
| 5,083,391 | 1/1992 | Kyler | 40/493 X |

*Primary Examiner*—Brian K. Green
*Attorney, Agent, or Firm*—Hill, Steadman & Simpson

[57] ABSTRACT

A rotary card file having a tumbler combination and latch for securing a pivotable cover over a series of cards held for rotation on a spindle beneath the cover. Actuating a select position of the tumblers allows a latch to clear a tab portion of the cover to allow pivoting of the cover to access the cards. Additionally, a swivel base is provided having a lock for selecting and locking the card file in a rotary orientation convenient for the user.

9 Claims, 3 Drawing Sheets

FIG. 3
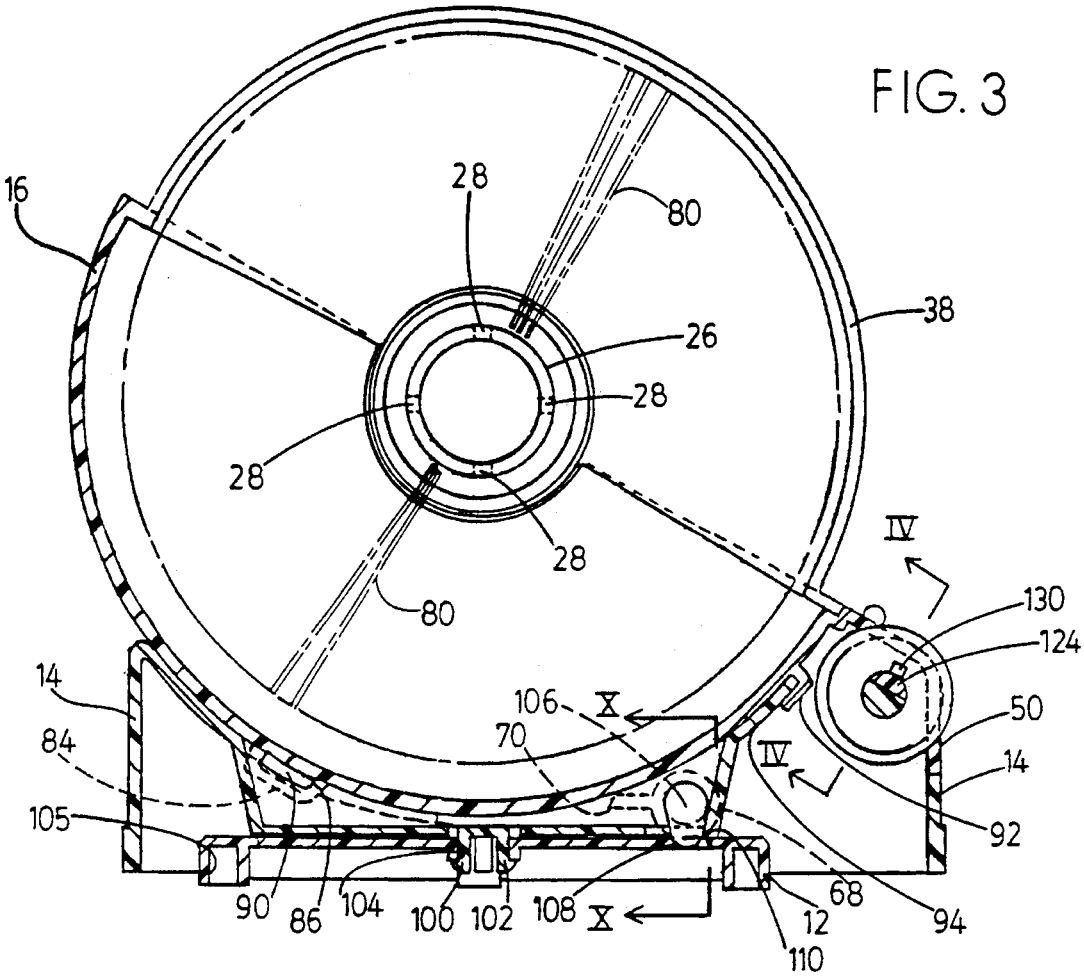
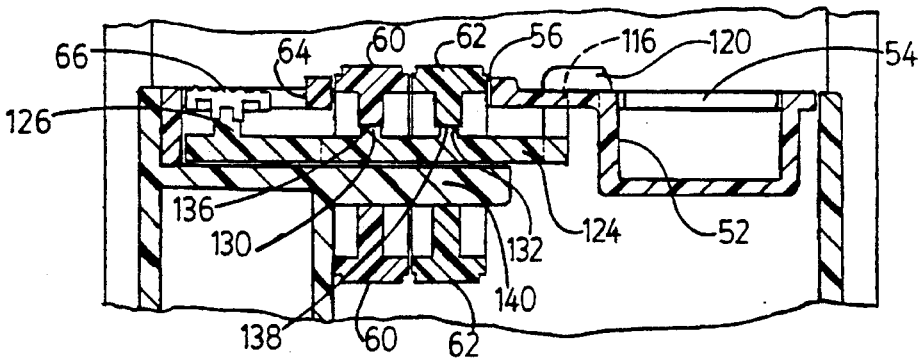
FIG. 4
FIG. 5
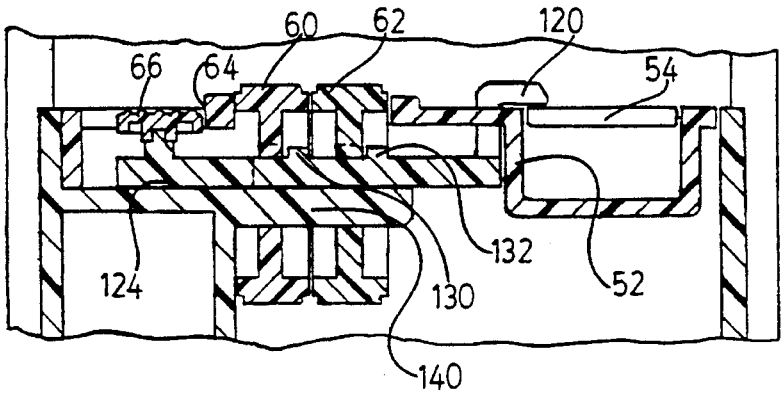

FIG. 6
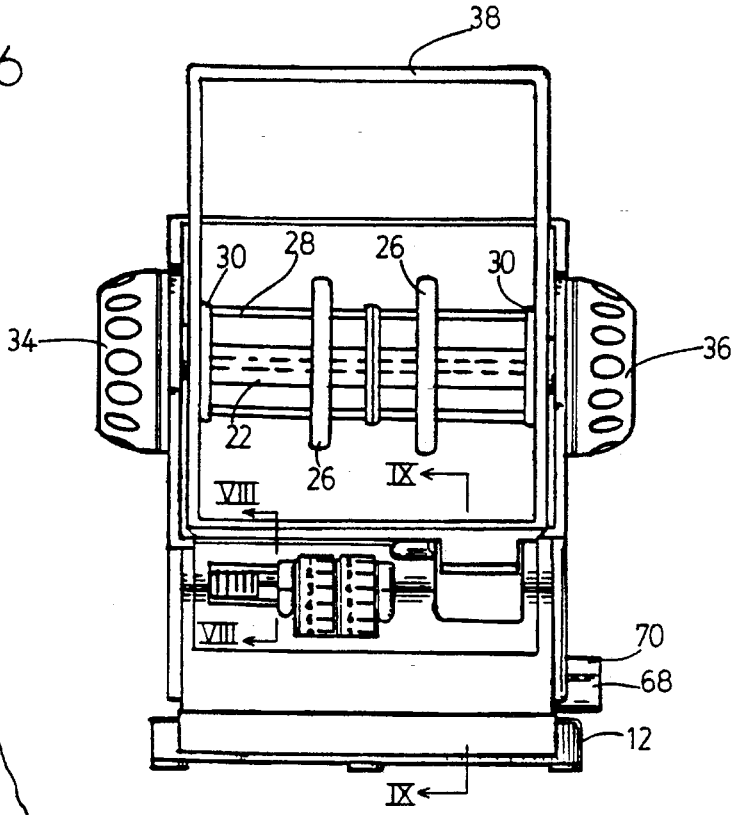
FIG. 9
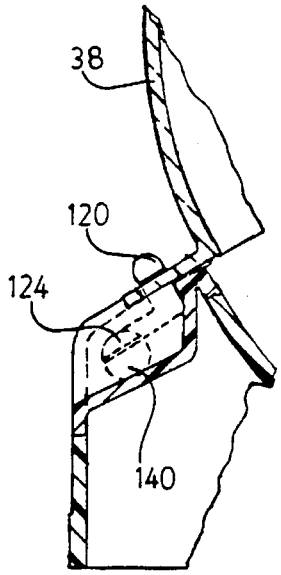
FIG. 7
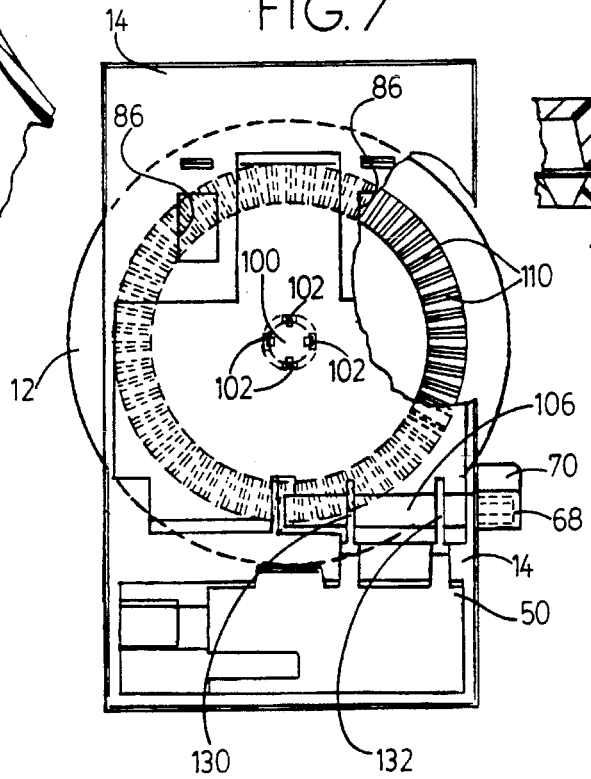
FIG. 10
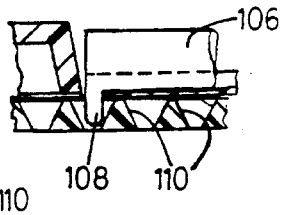
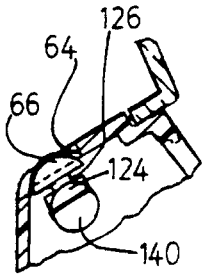
FIG. 8

ROTARY CARD FILES

BACKGROUND OF THE INVENTION

The present invention relates to rotary files such as rotary card files used in offices and homes such as for segregating business cards, recipes, telephone information, etc. The invention particularly relates to covered rotary files providing a lock for securing the files within the rotary file and a swivel mechanism for locking the file in a rotary orientation.

It is known in the art to provide a rotary card file having a pedestal mounted axle with rotary knobs and means for holding a plurality of cards extending radially therefrom beneath a clear cover such that a user can scan the collection of cards by turning either or both rotary knobs extending through the cover at the sides of the card file. Typically, the rotary card files are supported on rubber or felt feet which can become damaged. A relatively full and heavy card file can scratch a fine wood or otherwise smooth surface if turned and reoriented. In use, it is possible that two users sitting at a table, such as two telephone operators, may need visual access to the rotary file by turning on the table surface. An apparatus for facilitating and ease such turning while protecting the table surface is desirable.

It may be desirable to secure the card file against unauthorized access to the cards for removal or tampering or the cover can be in fact opaque wherein the cards cannot be viewed except when the cover is removed or pivoted out of line of sight of an observer. It would be advantageous to be able to lock the cover in place to prevent unauthorized access.

Additionally, larger rotary files and files which have excessive weight or card files which are intended to be anchored permanently to a structure, may be difficult to orient in a variety of facing positions to permit flexibility of access in a work area.

SUMMARY OF THE INVENTION

It is an object of the present invention to provide a rotary file which can be secured against unauthorized access to file cards held therein. It is another object of the invention to provide a rotary file which can be positioned in a plurality of orientations on a table surface easily and conveniently without relative movement with respect to the table surface.

The objects of the invention are inventively achieved with a rotary file having a pivotable half cylindrical cover with a radially extending tab, the tab lockable to a base of the rotary file to prevent the cover from being opened by pivoting. The object is further achieved in that a swivel base is provided below the rotary file, the swivel base capable of being locked into a select orientation with respect to the rotary file while remaining stationary with respect to the table surface.

BRIEF DESCRIPTION OF THE DRAWINGS

FIG. 3 is a sectional view taken generally along line III—III of FIG. 1;

FIG. 4 is a sectional view taken generally along line IV—IV of FIG. 3 with a card file lock in an unlocked position;

FIG. 5 is a sectional view according to FIG. 4 with the card file lock in a locked position;

FIG. 6 is a front elevational view of the card file of FIG. 1;

FIG. 7 is a plan view of the card file of FIG. 6 with a cradle portion removed for clarity;

FIG. 8 is a sectional view taken generally along line VIII—VIII of FIG. 6;

FIG. 9 is a sectional view taken generally along line IX—IX of FIG. 6; and FIG. 10 is a sectional view taken generally along line X—X of FIG. 3.

DETAILED DESCRIPTION OF THE PREFERRED EMBODIMENTS

Figure 1:
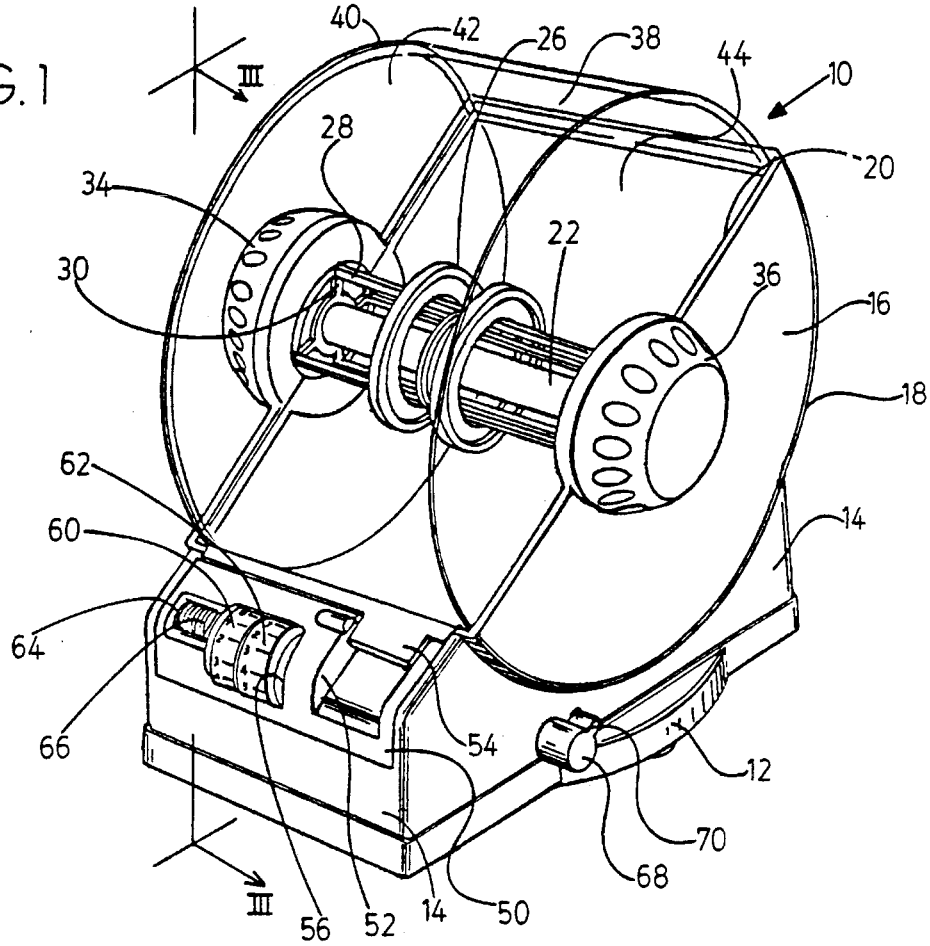
FIG. 1 is a perspective view of a rotary card file according to the invention.

FIG. 1 illustrates a rotary card file 10 having a swivel base 12 supporting a base frame 14 which holds a cradle 16 thereon. The cradle 16 has a half or semi-right cylindrical outer shell 18 with a rectangular open face 20. Held rotatably across the rectangular open face 20 is a spindle 22 having two card retaining rings 26 surrounding four rails 28 which are spaced around the spindle 22 and connected thereto by end spiders 30. The spindle is rotatable by two knobs 34, 36 extending outwardly of the cradle 16.

Arranged to overfit the cradle 16 is a cover 38 preferably made of a transparent material, but which could be opaque as well. The cover 38 comprises a half or semi-right cylindrical surrounding wall 40 and half circular side walls 42, 44. The cover 38 has a diameter slightly smaller than a diameter of the cradle 16 such that the cover 38 can be rotated around the spindle 22 to an open position overlying an inside surface of the cradle 16.

Attached to the base frame is a front side panel 50 having a lock recess 52. The cover 38 provides a locking tab 54 which fits into the locking recess 52. The front side panel provides an aperture 56 for exposing two lock tumblers 60, 62 having numbers displayed around their circumferences. Additionally, the front panel 50 provides an aperture 64 for exposing a catch button 66, see FIG. 8. A swivel lock 68 is provided exposed on one side of the base frame 14. The swivel lock 68 provides a radially extending handle 70 rotating the spindle lock 68.

Figure 2:
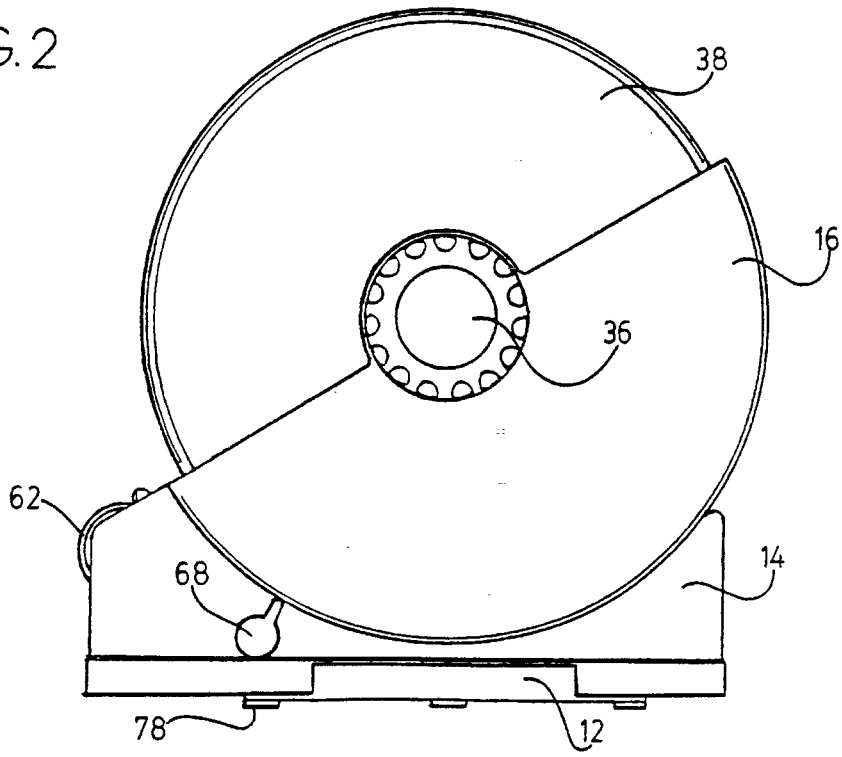
FIG. 2 is a right side view of the card file of FIG. 1.

As illustrated in FIG. 2, the base 12 provides a plurality of feet 78 for supporting the apparatus 10 on a table surface. The feet can be a soft material such as rubber or plastic for table scratch protection, or the feet can be attached to the table.

As illustrated in FIG. 3, a plurality of cards 80 are located between the rails 28 and locked on the rings 26 as is known. The cradle 16 is locked to the base frame 14 by two rearwardly facing hook tabs 84 which engage bar portions 90 through apertures 86 of the base frame 14. The cradle has a front hook portion 92 which engages a lip portion 94. The base frame 14 provides a spindle lock 100, having a plurality of hook portions 102, which interfits into a central aperture 104 of the base 12 to rotatably lock the base frame 14 to the base 12. The base 12 provides sockets 105 to hold the feet 78 (feet not shown in FIG. 3).

Connected to the swivel lock 68 is an axle 106. Connected to the axle 106 is a latch 108 shown in FIG. 10 which can be rotated to register with one of a plurality of notches or apertures 110 to lock the base frame 14 at a rotational position with respect to the base 12.

FIGS. 4 and 5 illustrate the operation of the cover latch. A recess 116 is provided in the front panel 50 for exposing a latch 120 which, as shown in FIG. 5, can overlie the tab 54 to prevent escape of the tab 54 from the recess 52, locking the cover 38 in place. The latch 120 has an approximate twisted Z-shape extending from a bar 124 (see FIG. 9), the bar running horizontally from the latch 120 to the catch button 66 which is attached to a formation 126 of the bar 124, see FIG. 8. The bar 124 provides two nubs 130, 132, which register with apertures 136, 138 of the tumblers 60, 62, respectively. The apertures 136, 138 are located corresponding to a particular rotational orientation of the tumblers 60, 62. When the tumblers 60, 62 are set at the proper orientation, the nubs 130, 132 can pass into the position of FIG. 4 as the catch button is manually moved to the left and the latch 120 is moved to the left to release the tab 54.

As shown in FIG. 5, the catch button 66 is positioned to the right within the aperture 64 to cause the latch 120 to overlie the tab 54 to lock the cover in place. The nubs 130, 132 have been displaced to the right of the tumblers 60, 62, respectively which can be randomly rotated to lock the bar 124 in its locked position.

As illustrated in FIG. 9, the bar 124 has a semicircular cross section as does a journal portion 140 of the cradle 14. The tumblers 60, 62 are journaled for rotation around both the bar 124 and the journal portion 140 as shown in FIG. 5.

FIG. 7 illustrates the base frame 14 and base 12 with the cradle removed for clarity. The plurality of notches 110 are seen arranged in a circle around the base 12 to allow for multiple positions of the base frame 14 with regard to the base 12. The axle 106 connecting the latch 108 to the swivel lock 68 is shown journaled by formations 130, 132 of the base frame 14.

Although the present invention has been described with reference to a specific embodiment, those of skill in the art will recognize that changes may be made thereto without departing from the scope and spirit of the invention as set forth in the appended claims.

We claim as our invention:

1. A rotary file for holding and selectively displaying information applied to cards, comprising:

a base assembly;

a spindle rotatably supported on said base assembly and having means for attaching cards thereto for rotation with rotation of said spindle;

a cover shaped for enclosing cards within a space defined by said base assembly and said cover, and said cover pivotable to an open position;

a means for locking said cover to said base assembly to secure cards within said space, and wherein said base assembly includes:

a base for supporting the rotary file therefrom;

a base frame rotatably connected by a fastening means to said base; and a means for locking said base frame in a select rotary position with respect to said base, said base frame supporting said spindle therefrom; and said means for locking said base frame with respect to said base comprises a plurality of notches arranged around a surface of said base and a latch arranged on said base frame, said latch having a handle portion for manual rotation of said latch to register with a select one of said notches.

2. The rotary file according to claim 1, wherein said means for locking comprises at least two tumblers having indicia around their circumference, said two tumblers alignable at select rotary position to release said means for locking for opening said cover.

3. The rotary file according to claim 2, wherein said means for locking comprises a slidable bar having a latch applied thereto and said cover comprises a radially extended tab arranged to underlie said latch when in the locked condition to prevent pivoting of said cover.

4. The rotary file according to claim 3, wherein said tumblers surround said bar and said bar comprises two nubs thereon in registry with two apertures on an inside diameter of said tumblers at said select rotary position.

5. The rotary file according to claim 1, wherein said base assembly further comprises a cradle having a semi-right circular cylindrical shape with an open rectangular face connected to said base frame and supporting said spindle in rotary fashion thereto.

6. The rotary file according to claim 5, wherein said cover comprises a semi-right circular cylindrical shape with an open rectangular face connected to said spindle rotatably thereto.

7. A rotary card file comprising:

a base portion for supporting said card file from a surface, and a body portion supported from said base portion, said body portion having a horizontally disposed spindle for rotationally holding a series of cards radially extending from said spindle to be accessed by a user, said body portion mounted for rotation to said base portion using a rotary connection means for rotating the body portion during operation;

a means for locking said body portion in a select rotational orientation with respect to said base portion;

a cover means for overlying said body portion to contain cards within said body portion; and a means for selectively locking said cover means to said body portion;

said means for locking comprises at least two tumblers having indicia around their circumference, said two tumblers alignable at select rotary position to release said lock means for opening said cover.

8. The rotary file according to claim 7, wherein said lock means comprises a slidable bar having a latch applied thereto and said cover comprises a radially extended tab arranged to underlie said latch when in the locked condition to prevent pivoting of said cover.

9. The rotary file according to claim 8, wherein said tumblers surround said bar and said bar comprises two nubs thereon in registry with two apertures on an inside diameter of said tumblers at said select rotary position.

* * * * *